US005474379A

United States Patent [19]

Perry

[11] Patent Number: 5,474,379

[45] Date of Patent: Dec. 12, 1995

[54] PORTABLE HIGH VOLUME CEMENT MIXER

[76] Inventor: L. F. Perry, Rte. 3, Box 28, Olney, Tex. 76374

[21] Appl. No.: 414,092

[22] Filed: Mar. 31, 1995

[51] Int. Cl.[6] ..... B28C 5/20

[52] U.S. Cl. ..... 366/26; 366/45; 366/62; 366/185; 414/332; 414/501; 414/598

[58] Field of Search ..... 366/16, 18, 26–28, 366/41, 45, 46, 53, 54–56, 60–63, 185, 187, 219, 220, 233, 606; 414/21, 332, 468, 497, 501, 503, 523, 595, 598, 919

[56] References Cited

U.S. PATENT DOCUMENTS

| | | | |
|---|---|---|---|
| 864,451 | 8/1907 | Davis . | |
| 1,209,668 | 12/1916 | Capron | 414/598 |
| 1,588,994 | 6/1926 | Rasmussen . | |
| 2,133,170 | 10/1938 | Johnson . | |
| 2,624,480 | 1/1953 | Bartling | 414/595 |
| 2,740,539 | 4/1956 | Oaks, Jr. . | |
| 3,145,976 | 8/1964 | August et al. | 366/26 |
| 3,148,867 | 9/1964 | August et al. . | |
| 3,191,914 | 6/1965 | August | 366/26 |
| 3,244,411 | 4/1966 | Kühner . | |
| 3,421,744 | 1/1969 | O'Connell . | |
| 4,339,204 | 7/1982 | Placzek | 366/18 |
| 4,525,070 | 6/1985 | Gressette, Jr. | 366/18 |
| 4,775,275 | 10/1988 | Perry | 414/21 |
| 4,951,261 | 8/1990 | Strehlow | 366/45 |

FOREIGN PATENT DOCUMENTS

| | | | |
|---|---|---|---|
| 1092437 | 11/1954 | France | 366/26 |
| 1177055 | 8/1964 | Germany | 366/26 |
| 1459220 | 1/1969 | Germany | 366/26 |
| 3604331 | 8/1987 | Germany | 366/26 |

*Primary Examiner*—Charles E. Cooley

*Attorney, Agent, or Firm*—Dougherty, Hessin, Beavers & Gilbert

[57] ABSTRACT

An improved portable, large volume cement mixer that includes a self-supporting inclined plane secured atop a wheeled main frame that provides basic structural support without the need for ancillary lifting equipment. The inclined plane is constructed in upper and lower hinged truss beams, upwardly hinged for operation and downwardly hinged for transport. A trolley carrying a cement mixer drum is then movable along the length of the inclined plane during operation, whereupon large batches of cement may be mixed and dispensed into waiting local carriers or trucks.

15 Claims, 4 Drawing Sheets

PORTABLE HIGH VOLUME CEMENT MIXER

CROSS-REFERENCE TO RELATED APPLICATIONS

The present application is related to U.S. Pat. No. 5,411,329 entitled "Portable Large Volume Cement Mixer for Batch Operations" as filed on Jun. 28, 1993.

BACKGROUND OF THE INVENTION

1. Field of the Invention

The invention relates generally to improvements in the related invention which improvements are directed to the set-up and product delivery aspects of the invention. Thus, the structure includes an improved form of foldable elongated frame as well as a cement mixer carriage drive assembly capable of greater speed and efficiency.

2. Description of the Prior Art

The prior art includes various types of batching plants, both permanent and mobile installations, and these batching plants are intended to function with the conventional cement mixing trucks, i.e., the hatching plants serving to weigh and deliver the ingredient components while the mixing trucks function to mix and deliver the concrete to a construction site. Patents cited in the related application are believed to be of general interest only as regards the present invention; however, those patents are listed in the Information Disclosure Statement filed herewith.

SUMMARY OF THE INVENTION

The present invention relates to high volume cement mixers of the portable type that are used in combination with selected existing types of concrete batching plants that also may be of the portable type. In particular, the present invention could be used in combination with a portable concrete batching plant such as that of U.S. Pat. No. 4,775,275 which functions to meter out and deliver each of the dry component materials of concrete to a discharge point in the structure. The present invention is a wheeled and towable structure which can be set up adjacent the batching plant to place a high volume concrete mixer at the materials discharge point so that the mixture can receive component materials, rotationally mix the concrete, and thereafter dump the concrete into selected conveyors or trucks for delivery to a construction site.

The portable mixer includes a main frame that is supported on a plurality of wheels to carry an incline ramp that is rigidly positioned at an angle of about 45°. The main incline ramp structures are carried on each side of the main frame with a wheeled trolley carriage rollably disposed on each side incline ramp, and with the cement mixer tank rotatably held between the opposite trolley carriages while being supported for hydraulically driven mixing rotation about the longitudinal tank axis. A pair of opposite side forward incline ramps are hingedly secured to the forward end of the main incline ramps and hydraulically controllable between their upright or inclined position with ramps aligned and a downward position for the transport mode. The forward incline ramps may be lowered to a position where the forward end of the forward incline ramp provides seating of a gooseneck truck connector. When the forward incline ramp is in its lower position, the transport mode, a mixer outlet funnel beneath the forward incline ramp bears against the forward end of the wheeled main frame. A funneling structure at the rear end of the main frame provides charging input of the various component materials.

Therefore, it is an object of the present invention to provide a portable mixer that is lower in height and more easily assembled into operational configuration.

It is also an object of the invention to provide a portable cement mixer that is more easily positioned and operated beneath most forms of portable batching plant.

It is yet further an object of the present invention to provide a large volume cement mixer of the portable type that is self-erecting and requires no ancillary support equipment.

Finally, it is an object of the present invention to provide a forward dumping cement mixer that is easier to control and operate while processing very large volumes of prepared cement.

Other objects and advantages of the invention will be evident from the following detailed description when read in conjunction with the accompanying drawings that illustrate the invention.

DETAILED DESCRIPTION OF THE INVENTION

Figure 1:
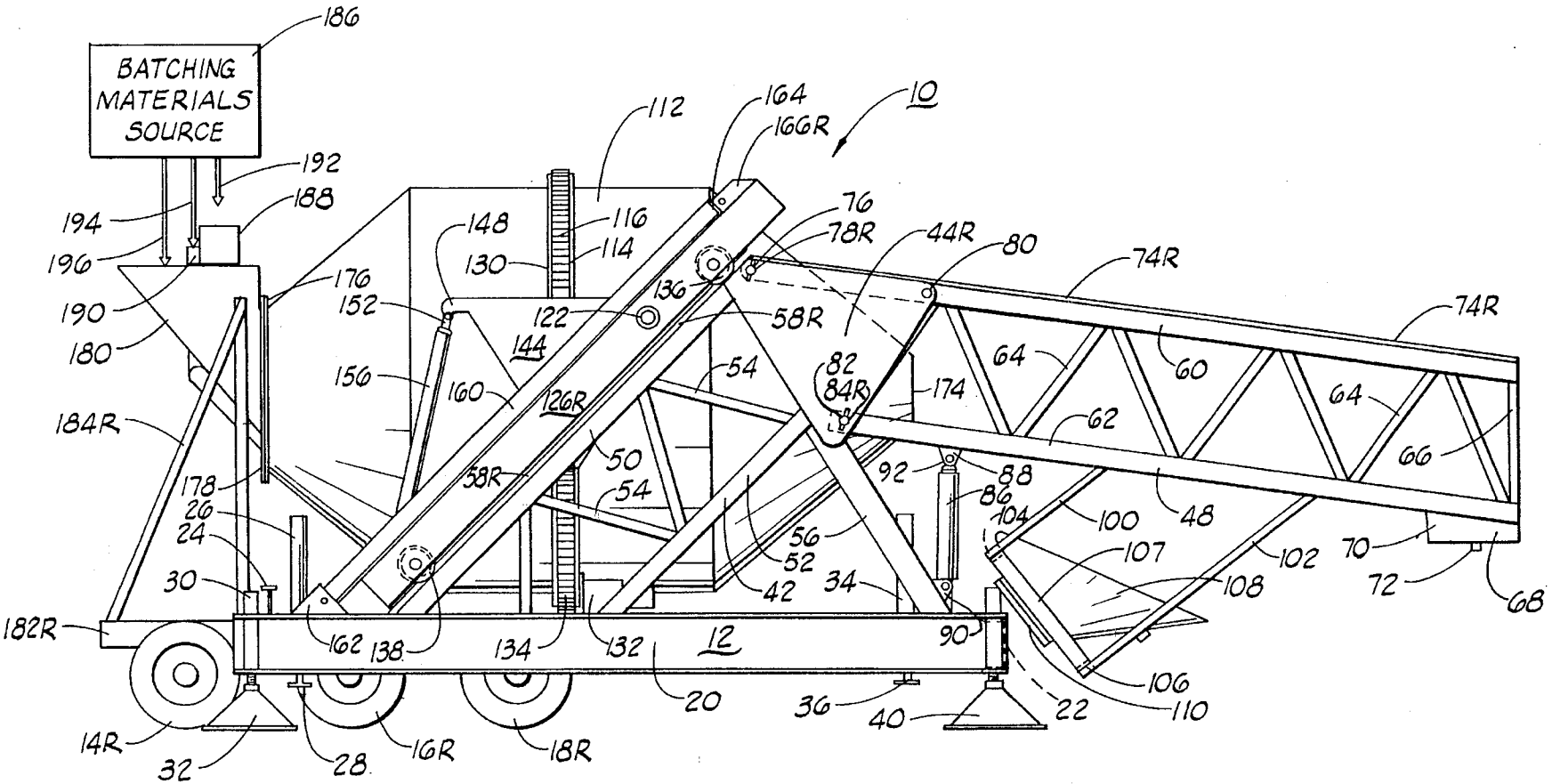
FIG. 1 is a side view in elevation of the portable cement mixer in transport mode.
Figure 2:
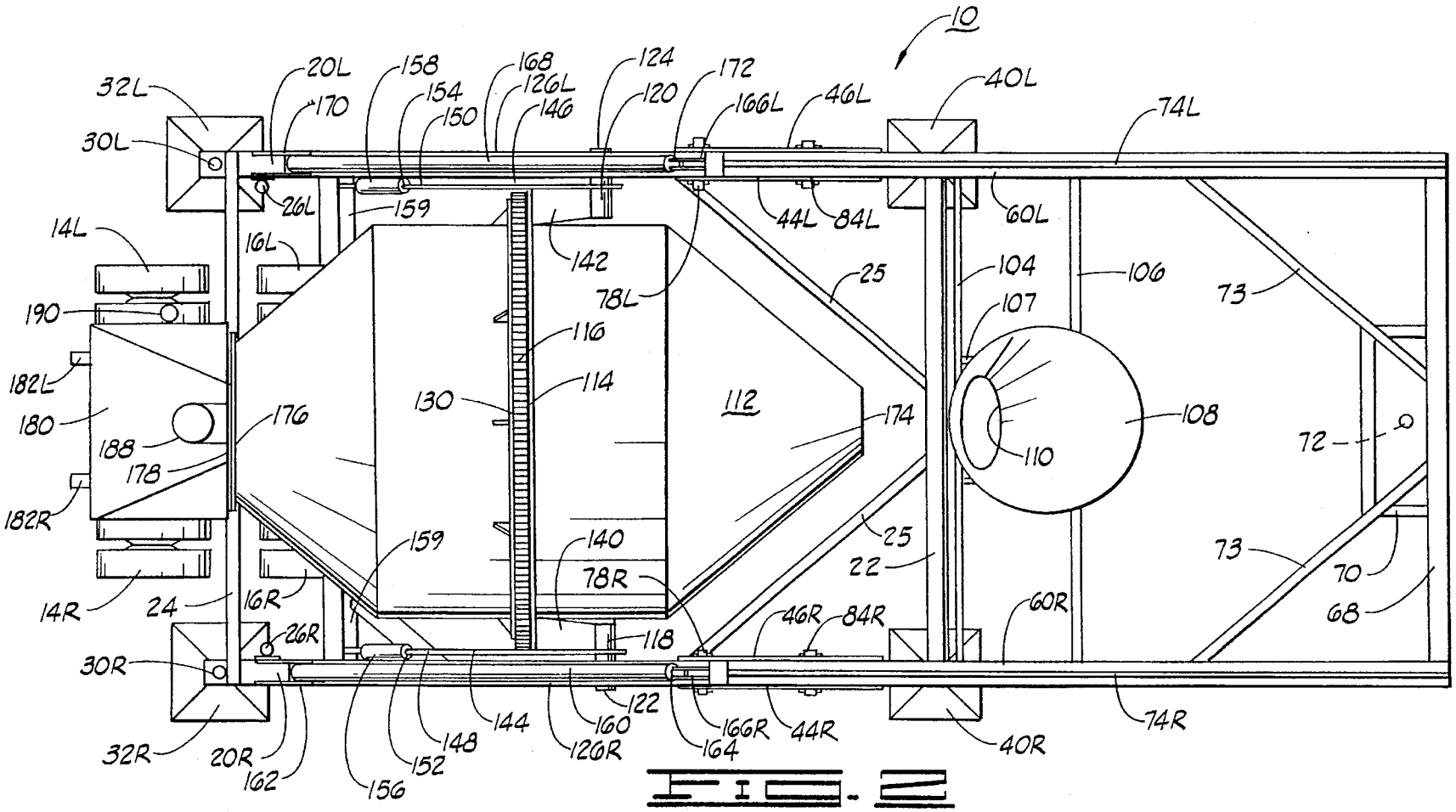
FIG. 2 is a top plan view of the structure of FIG. 1.

Referring to FIGS. 1 and 2, the portable cement mixer 10 is carried on a main frame 12 that is mobilely supported on a plurality of opposite side wheel pairs 14, 16 and 18R and L. The main frame 12 is made up of opposite side I-beams 20 interconnected by means of forward transverse beam 22 and rearward transverse beam 24 connected in rectangular array. Angular braces 25 (FIG. 2) reinforce the forward corners of main frame 12. At the rear end, hydraulic leveling jacks 26 position leveling pads 28 while opposite side screw jacks 30 place foot pads 32 in permanent ground contact. At the front end of main frame 12, opposite side hydraulic leveling jacks 34 control ground pads 36 while screw jacks 38 operate to place foot pads 40 in ground contact.

The superstructure on each side of main frame 12 is identically constructed to include lower truss beams 42 secured to the respective side beams 20 of main frame 12, with the upper end of truss beams 42 hingedly connected through respective hinge plates 44L and R and 46L and R to an upper truss beams 48. The lower truss beams 42 each consist of upper and lower beams 50 and 52 which are secured in parallel and approximately 45° angle to the opposite side beams 20 of main frame 12. A plurality of angular struts 54 are then secured as by welding between beams 50 and 52. The lower beams 52 are supported by welded angular braces 56 secured to opposite side beams 20. A pair of triangular hinge plates 44R and L and 46R and L (see FIG. 2) are then secured as by welding on each side of beams 50 and 52 to extend forward therefrom in parallel. Lower guide rails 58R and L are secured centrally along the length of upper beams 50.

The upper truss beams 48 are similarly constructed with upper and lower beams 60 and 62 disposed in parallel and braced by a plurality of angular struts 64. The outer or upper end of lower truss beams 48 terminate in a transverse beam 68 which also forms part of the gooseneck connector box 70 that supports the male gooseneck connector 72. Angular braces 73 reinforce the forward frame corners adjoining transverse beam 65, as shown in FIG. 2.

Upper guide rails 74R and L are supported centrally along the length of upper beams 60. The opposite side hinge plates 44R and L and 46R and L are each similarly formed to have upper holes 76 for permanently receiving a lockable roll pin 78R and L. The hinge plates 44R and L and 46R and L also have forward holes 80, which receive no pin during transport mode, but which are connected by roll pin to the inner end of lower beam 48 during operational mode, as will be further described. Also, the hinge plates 44R and L and 46R and L each have lower holes 82 which receive roll pins 84R and L (as shown in FIG. 1) in secure fixture to the inner end of lower beams 62 during transport mode.

Opposite side multi-stage hydraulic cylinders 86 are connected on each side between a pivot plate 88 welded on the lower side of lower beam 48, and a pivot plate 90 secured at the base of angular brace 56. Actuation of the opposite side multi-stage hydraulic cylinders 86 extends the rod ends 92 to force the upper beams 60 upward when the roll pin 84 is removed from hole 82. Full extension of multi-stage hydraulic cylinders 86 move the upper beams 60 into alignment with upper beams 50 of the lower truss beams 42, whereupon the inner end of lower beams 62 aligns with hinge holes 80, and roll pin 84 is positioned therein to maintain the truss beam aligned (FIGS. 3 and 4) thereby to maintain the lower guide rails 58 and upper guide rails 74 in alignment.

Opposite side pairs of bars 100 and 102 are secured to the bottom edge of truss beams 48 in parallel and at an angle of about forty-five degrees. A pair of transverse bars 104 and 106 are secured between opposite side bars 100 and 102, respectively, and a rectangular frame 107 is secured centrally between transverse bars 104 and 106 to provide secure seating for a dump funnel 108 having a lower opening 110. In the road or transport position, with upper truss beams 48 in the lower position, the dump funnel 108 may be secured adjacent the forward end of main frame 12.

A large volume cement mixer drum 112 having a circumferal yoke flange 114 and ring gear 116 is pivotally supported by opposite side pivot assemblies 118 and 120 supported on respective pivot axles 122 and 124 which are pivotally secured in the opposite side trolley carriage assemblies 126R and 126L. The yoke flange 114 is rigidly positioned in surround of the mixer drum 112. A large ring bearing 130 has a first race secured circumferally around mixer drum 112 and, therefore, in rigid security to ring gear 116, and ring gear 116 is securely affixed to mixer drum 112 to ride against bearing 130 during revolution.

A hydraulic motor 132 is mounted proximate main frame 12 at the underside of mixer drum 112 in secure mount through yoke flange 114 so that a drive gear 134 is positioned in contact with ring gear 116. Activation of the hydraulic motor 132 rotates the mixer drum 112 during the cement mixing function.

Each of the opposite side trolley carriages 126R and 126L is of a similar construction and interconnection as they support the opposite side pivot axles 124 and 122. The carriage 126R has forward and rearward grooved wheels 136 and 138 which ride on the guide rails 58R and 74R. Similar wheel structure is to be found on the opposite side carriage 126L as it is retained to ride on the opposite side rails 58L and 74L. The pivot assemblies 118 and 120 provide journalling to support the pivot axles 122 and 124, and they are each rigidly affixed by means of guide arms 140 and 142 to the rear, opposite side points of yoke flange 114. The opposite side guide arms 140 and 142 are also rigidly secured as by welding to respective lever plates 144 and 146 which are co-journaled on pivot axles 122 and 124. The lever plates 144 and 146 are formed to extend lever arms 148 and 150, respectively, which are each pivotally secured to a cylinder rod end 152 and 154 of respective hydraulic cylinders 156 and 158. The hydraulic cylinders 156 and 158 are anchored at opposite sides of a transverse brace 159 (FIG. 2) connected between opposite carriages 126R and L. Cylinders 156 and 158 function to tilt the mixer drum 112 forward during off-loading operation, as will be further described.

On the right hand side, an elongate hydraulic cylinder 160 connected to a pivot bracket 162 is secured on side beam 20 to extend along the length of trolley carriage 126R. The rod end 164 is pivotally secured to a pivot block 166R that is welded to the front end of carriage 126R. The left side enjoys similar construction as an elongate hydraulic cylinder 168 is pivotally secured to a pivot block 170 secured on top of beam 20L to extend along the length of carriage 126L whereupon rod end 172 is pivotally secured to a pivot block 166L. The hydraulic cylinders 160 and 168 are operated in concert to extend rods to push the carriage assemblies 126R and L up along the respective rails 58R and L and 74R and L. See FIG. 3.

A front end 174 of mixer drum 112, which may be gated if desired, allows dumping of the mixer content during operation, as will be described. A rear flanged opening 176 is normally positioned in abutment with a flange 178 leading to a loading funnel 180 that is supported on opposite side frame braces 182 and uprights 184.

Input charging of mixer drum 112 is provided by a suitable batching materials source 186. For example, a particularly compatible source would be a mobile batch plant as disclosed in U.S. Pat. No. 4,775,275. Solids director 188, funnel 180 and liquids director 190 provide input via the funnel 180 to mixer drum 112 in accurately measured parts whereupon the cement mixing operation can begin by energizing hydraulic motor 132 and commencing rotation of cement mixer drum 112.

In operation, the portable mixer 10 under control of a tractor connected at gooseneck 72 would be transported to the designated station and backed beneath a batching material source 186. As stated previously, this could be a batching plant as described in U.S. Pat. No. 4,775,275 and shown in the related application Ser. No. 08/082,725; or, it could be any of the available batching stations which function to provide water, aggregate, cement and other additives in the prescribed measured amounts. Thus, cement input 192, water input 194 and aggregate input 196 (FIG. 1) place all required materials into the input end 176 of mixer drum 112. Hydraulic motor 132 may then be energized to drive the ring gear 116 and rotate the mixer drum 112.

The main frame 12 will have been properly positioned beneath the batching plant as hydraulic leveling jacks 26 and 34 are operated to properly level the main frame 12 and screw jacks 30 and 38 are operated to permanently position jack feet 32 and 40 on each side of main frame 12 for permanent support positioning.

Figure 3:
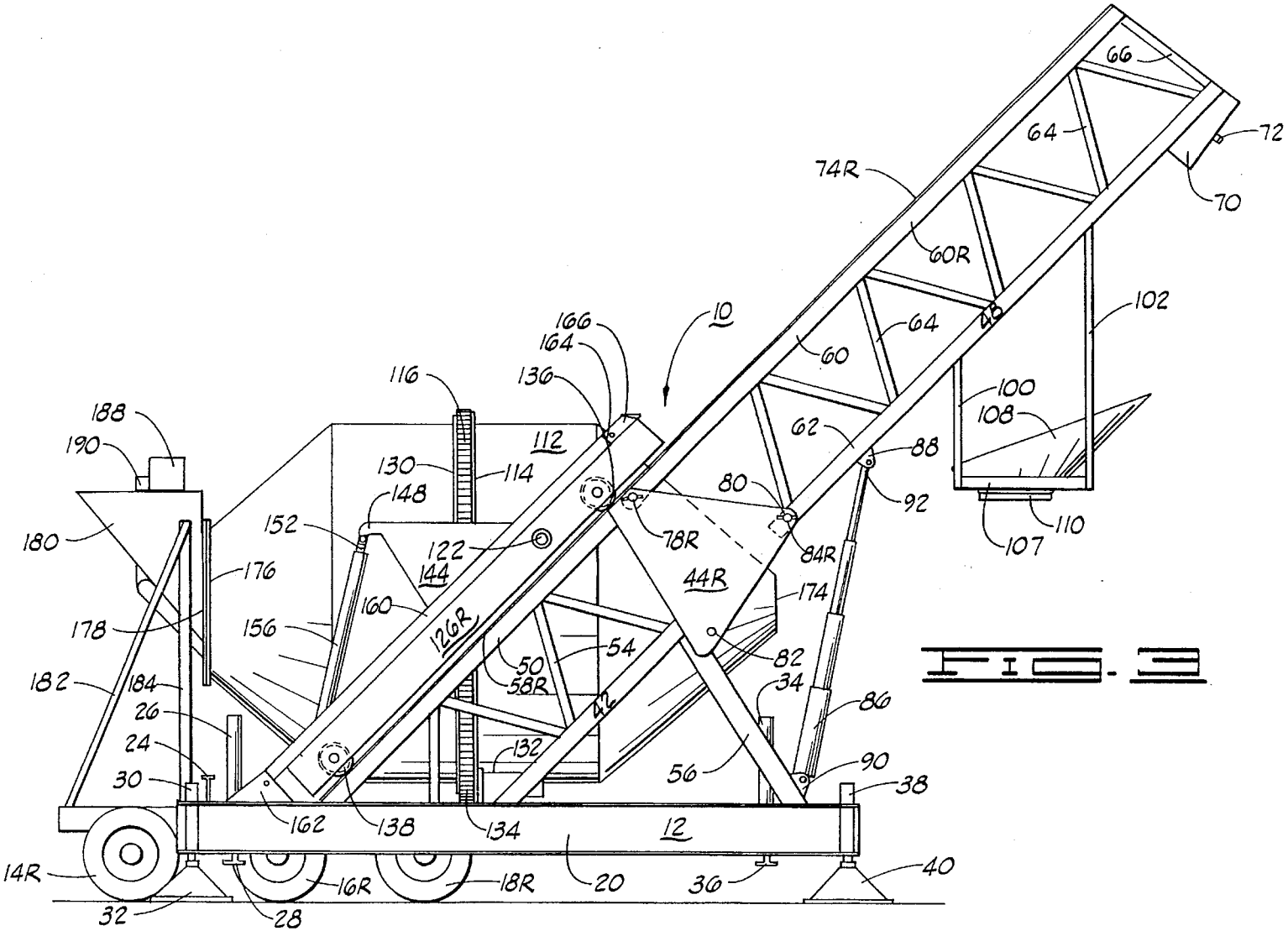
FIG. 3 is a side view in elevation of the portable cement mixer when erected into operational mode.

While rotation of mixer drum 112 continues, the pin 84R (FIG. 1) is removed and the opposite side multi-stage cylinders 86 are energized to extend rod ends 92 on each side thereby to raise the upper truss beams 48 upward so that lower beam 62 end holes align with forward holes 80 of hinge plates 44R and L and 46R and L, whereupon the pins 84R and L are reinserted to maintain the aligned, upright structure as shown in FIG. 3.

In the fully assembled attitude of FIG. 3, the cement mixer drum 112 is free to continue to rotate and to complete the materials mix, and the off-loading structure is in place as upper beam 48 is erected to position dump funnel 108 over an area where distributing trucks may pass under to receive loads of concrete for further delivery to worksites.

Figure 4:
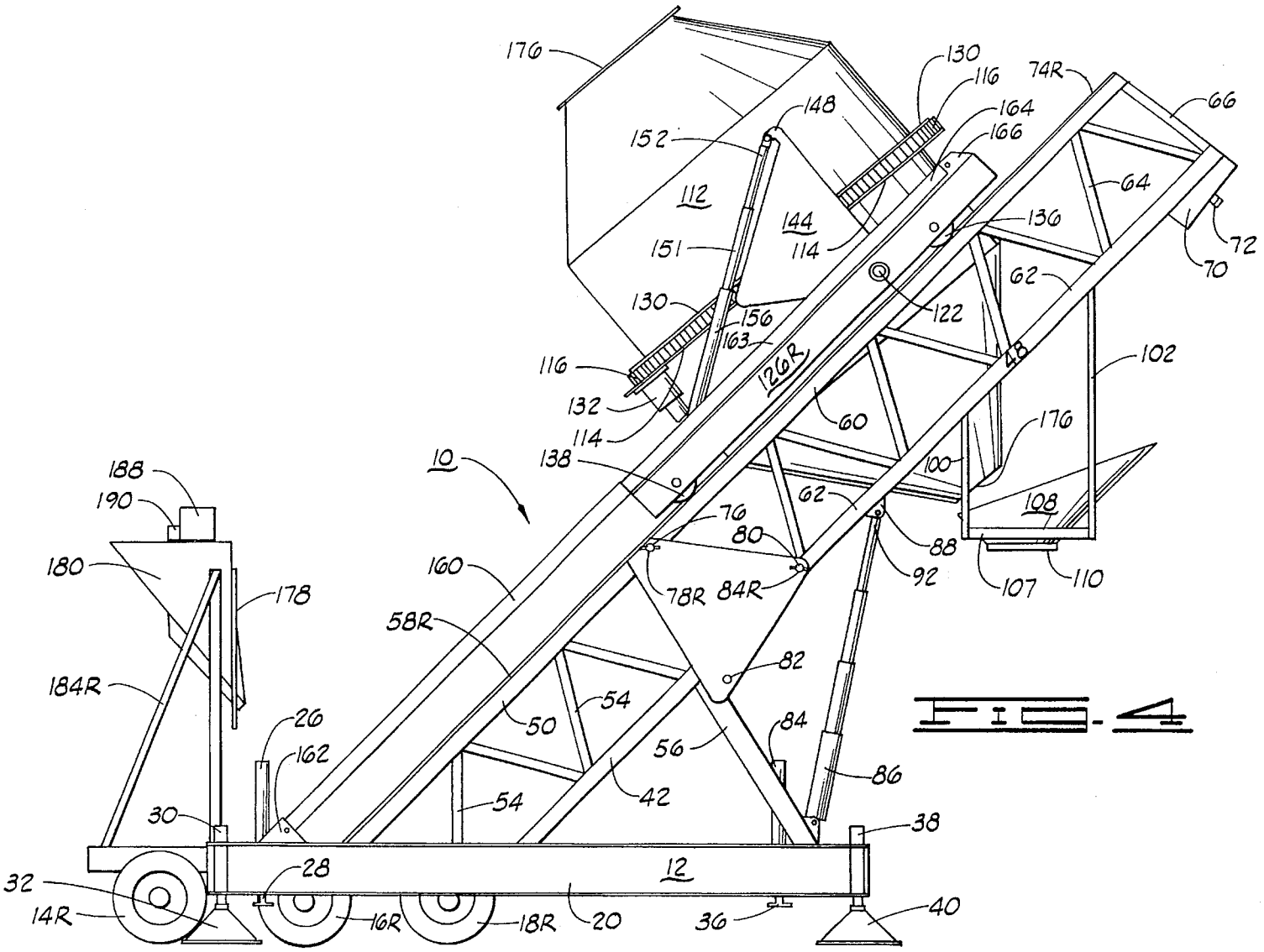
FIG. 4 is a side view in elevation of the portable cement mixer with the cement mixer elevated to the dump mode.

When cement mixing is complete, the portable mixer 10 is ready for operation in the off-loading phase. Thus, referring to FIGS. 3 and 4, the hydraulic cylinders 160 and 168 are energized to extend the actuator rods 163 and rod ends 164 and 172 to full extent so that they carry the opposite side trolley carriages 126R and L to their uppermost position along the guide rails 58R and L and 74R and L, as shown in FIG. 4. Fine dumping control is then exercised by operation of the opposite side hydraulic cylinders 156 and 158 to extend their actuation rods 151 and rod ends 152 and 154 thereby to rotate the lever plates 144 and 146 (FIG. 2) which rotate the guide arms 140 and 142 to raise the yoke ring 114 and up-end the cement mixer 112 to the attitude shown in FIG. 4. Thus, the cement mixer drum 112 is directed downward with the front opening 176 dumping into the dump funnel 108 for direction into the load bed of a waiting truck or trolley. Parceling control of the cement through loading of various successive batches is done through the operation of hydraulic cylinders 156 and 158. Thus, the cement mixer drum 112 can be up-ended to dump position while a truck awaits loading, and can then be lowered to the level position until the loaded truck drives off and a next truck drives into the loading position.

After completion of the job when no more cement mixture is required, the portable cement mixer 10 may be dismantled or broken down to its transport configuration in relatively simple manner with no outside machinery or other aids being required. The mixer drum 112 can be lowered to the mix position, as shown in FIG. 3, by retracting the actuator rods 163 of hydraulic actuators 160 and 168. Next, the opposite side pins 84R and L may be removed and the multi-stage actuator 86 is energized to retract the rod ends 92 while also lowering the upper truss beam 48 down to the attitude as shown in FIG. 1. The beam 62 then aligns rearward holes with hinge plate hole 82 for reinsertion of roll pins 84R and L thereby securing the unit for travel. Adjustment of the opposite side jacks rests the opposite side wheels 14R and L, 16R and L, and 18R and L on the ground, and the tractor carrier need only hook up to gooseneck post 72 to be road ready.

The foregoing discloses an improved form of portable large volume cement mixer which embodies some of the basic elements of the related application Ser. No. 08/082,725, but which also teaches certain improved features that render the portable cement mixer totally self-sustaining with no need for ancillary lifting or propping equipment. The improved unit includes hydraulically controlled positioning members for fully erecting the upper and lower truss beams to full incline plane while jack assemblies support the main frame in balanced manner. The improved structure also embodies an improved form of trolley carriage for moving the mixer drum up and down on the incline plane between mixing and cement dumping positions. The unit as improved is now an efficient, self-sustaining equipment for use in concrete mixing operations at selected batching sites.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A portable cement mixer for installation at selected worksites, comprising:

a main frame wheel-supported for towed movement to a worksite;

an inclined plane rigidly mounted rearward on said main frame and extending forward at about a 45° angle;

trolley means movable along said inclined plane between a rearward operating position and a forward dump position;

a cement mixer drum mounted on said trolley means for controlled rotation in axially horizontal disposition;

first hydraulic cylinder means mounted on said trolley means and actuatable to pull said trolley means and said cement mixer drum up along said inclined plane to the dump position; and second hydraulic cylinder means mounted on said trolley means for tilting said cement mixer drum forward to dump mixed cement at the dump position.

2. A portable cement mixer as set forth in claim 1 wherein the inclined plane comprises:

a pair of lower truss beams, each pair rigidly affixed in parallel on opposite sides of said main frame and each pair including the respective upper beam end;

first and second pairs of hinge plates, each pair rigidly secured on opposite sides to respective ones of said lower truss beam upper beam ends;

a pair of upper truss beams, each pivotally secured to a respective one of said first and second pairs of hinge plates; and a pair of hydraulic cylinders connected between the main frame and a respective one of the upper truss beams, which hydraulic cylinders are actuatable in concert to move the upper truss beams between a lowered transport mode position and a raised operating mode position where the lower and upper truss beam pairs are aligned.

3. A portable cement mixer as set forth in claim 2 which further includes:

a guide rail secured along each of said pairs of lower and upper truss beams.

4. A portable cement mixer as set forth in claim 3 wherein said trolley means comprises:

first and second carriage means disposed on opposite sides of the inclined plane with each being in pivotal affixure about a transverse axis to said cement mixer drum;

front and rear grooved wheels supporting each of said carriage means for riding in engagement on said truss beam guide rails.

5. A portable cement mixer as set forth in claim 2 wherein each of said hinge plates comprises:

a triangular plate having front, back, and bottom holes; and means for pinning the back and bottom holes to the respective upper truss beam thereby attaching the upper truss beam in the lowered, transport mode position.

6. A portable cement mixer as set forth in claim 5 which further includes:

a forward transverse beam connected between said upper truss beams; and gooseneck towing means secured centrally on said transverse beam.

7. A portable cement mixer as set forth in claim 2 wherein each of said hinge plates comprises:

a triangular plate having front, back, and bottom holes; and means for pinning the back and front holes to the respective truss beam thereby attaching the upper truss beam in alignment in the raised, operational mode position.

8. A portable cement mixer as set forth in claim 1 wherein said trolley means comprises:

first and second carriage means disposed on opposite sides of the inclined plane with each being in pivotal affixure about a transverse axis to said cement mixer drum; and front and rear guide wheels supporting each of said carriage means and riding in engagement along said inclined plane.

9. A portable cement mixer as set forth in claim 8 wherein said first hydraulic cylinder means comprises:

first and second hydraulic cylinders each connected to the main frame and extending along said first and second carriage means with respective cylinder rod ends connected to respective carriage means and extendable to pull the carriage means up the inclined plane.

10. A portable cement mixer as set forth in claim 8 wherein said second hydraulic cylinder means comprises:

first and second lever plates pivotally secured to said first and second carriage means and extending first and second lever arms;

third and fourth hydraulic cylinders connected to said trolley means with respective rod ends connected to said first and second lever arms, and actuatable to extend said rod ends and rotate said first and second lever arms thereby to tilt the cement mixer drum forward.

11. A portable cement mixer as set forth in claim 8 wherein said cement mixer drum comprises:

a drum of generally ovate volume having a cylindrical midsection adjoined by connate ends;

a circular yoke flange and bearing disposed centrally around said cylindrical mid-section to support said drum while allowing rotation; and first and second opposite side guide arms rigidly secured to said yoke flange and pivotally secured to respective first and second carriage means.

12. A portable cement mixer as set forth in claim 11 which further includes:

first and second lever plates rigidly secured to respective opposite side guide arms and extending first and second lever arms;

whereby said second hydraulic cylinder means connect to said first and second lever arms.

13. A portable cement mixer as set forth in claim 11 which further includes:

a ring gear rigidly secured around said drum centrally adjacent said circular yoke flange;

a hydraulic motor secured on said circular yoke flange adjacent the ring gear; and a drive gear receiving rotation from said hydraulic motor and engaged with said ring gear.

14. A portable cement mixer as set forth in claim 1 wherein said main frame comprises:

a rectangular frame having opposite side beams and forward and rear transverse beams defining four corners; and four adjustable jacks with foot pads for ground contact rigidly secured at each of said four corners.

15. A portable cement mixer for installation at selected worksites, comprising:

a main frame having front and rear ends that is multi-wheel supported for towed movement to a worksite;

adjustable stabilizing means disposed about said main frame in balanced relationship;

an inclined plane consisting of upper and lower sections hingedly connected with the lower section rigidly secured at about a 45° angle to the rear end of the main frame, said upper section being foldable between a downward folded transport position and an upward folded operating position where said lower and upper sections are aligned;

a trolley disposed on said inclined plane for movement therealong when in an operating position;

a cement mixer drum pivotally secured to said trolley about a transverse axis with said mixer drum being rotatable;

means for rotating the cement mixer drum at a controlled rate of revolution;

means for moving said trolley upward along the inclined plane to a predesignated position; and means for tilting the cement mixer drum forward to a dump attitude to off-load prepared cement.

* * * * *